US006453010B1

(12) United States Patent
Miller et al.

(10) Patent No.: US 6,453,010 B1
(45) Date of Patent: Sep. 17, 2002

(54) X-RAY TUBE LIQUID FLUX DIRECTOR

(75) Inventors: Thomas R. Miller, St. Charles; Cheryl L. Panasik, Elburn; Qing Lu, Aurora, all of IL (US)

(73) Assignee: Koninklijke Philips Electronics N.V. (NL)

( * ) Notice: Subject to any disclaimer, the term of this patent is extended or adjusted under 35 U.S.C. 154(b) by 15 days.

(21) Appl. No.: 09/593,641

(22) Filed: Jun. 13, 2000

(51) Int. Cl.[7] ..... H01J 35/10
(52) U.S. Cl. ..... 378/130; 378/127; 378/141
(58) Field of Search ..... 378/130, 132, 378/140, 131, 141, 127; 313/32, 35

(56) References Cited

U.S. PATENT DOCUMENTS

| | | | | |
|---|---|---|---|---|
| 3,942,059 A | | 3/1976 | Tran-Quang | 338/130 |
| 4,674,109 A | | 6/1987 | Ono | 378/130 |
| 5,416,820 A | | 5/1995 | Weil et al. | 378/130 |
| 5,535,255 A | | 7/1996 | Gabbay | 378/141 |
| 5,579,364 A | * | 11/1996 | Osaka et al. | 378/141 |
| 5,673,301 A | | 9/1997 | Tekriwal | 378/130 |
| 6,011,829 A | | 1/2000 | Panasik | 378/130 |
| 6,249,569 B1 | * | 6/2001 | Price et al. | 378/130 |

* cited by examiner

*Primary Examiner*—Drew A. Dunn
(74) *Attorney, Agent, or Firm*—Eugene E. Clair

(57) ABSTRACT

An x-ray tube apparatus includes a housing defining a chamber and an x-ray tube mounted therein. The x-ray tube includes an envelope defining an evacuated void in which an anode assembly is rotatably mounted to a bearing assembly. The anode assembly interacts with a cathode assembly for the production of x-rays. The bearing assembly includes a cooling channel that is defined within the bearing assembly to direct cooling fluid, such as oil, across an inner surface of the bearing housing. A flow director is located in a fluid input port in the housing and has a fluid input aperture for connecting the flow director to the heat removal system. A cavity is defined by the housing of the flow director and two fluid output apertures are in fluid communication with each other and the fluid input opening. One of the fluid output apertures supplies cooling fluid to the cooling channel in the bearing assembly and the other fluid output aperture supplies cooling fluid to the chamber in the housing. The fluid director provides a desired predetermined portion of supplied fluid flow of the cooling fluid to the cooling channel and/or chamber.

23 Claims, 4 Drawing Sheets

X-RAY TUBE LIQUID FLUX DIRECTOR

TECHNICAL FIELD

The present invention relates to x-ray tube technology. More specifically, the present invention relates to a method and apparatus for directing cooling fluid supplied from a reservoir to (i) a bearing cooling apparatus and (ii) an x-ray tube housing chamber to reduce the heating effects on x-ray tube bearings caused by heat dissipated from the anode during operation.

BACKGROUND OF THE INVENTION

Conventional diagnostic use of x-radiation includes the forms of (i) radiography, in which a still shadow image of the patient is produced on x-ray film, (ii) fluoroscopy, in which a visible real time shadow light image is produced by low intensity x-rays impinging on a fluorescent screen after passing through the patient, and (iii) computed tomography (CT) in which complete patient images are digitally constructed from x-rays produced by a high powered x-ray tube rotated about a patient's body.

Typically, an x-ray tube includes an evacuated envelope made of metal or glass which is supported within an x-ray tube housing. The x-ray tube housing provides electrical connections to the envelope and is filled with a fluid such as oil to aid in cooling components housed within the envelope. The fluid is circulated through the housing and a heat exchanger external to the housing for removing heat from the cooling fluid. The envelope and the x-ray tube housing each include an x-ray transmissive window aligned with one another such that x-rays produced within the envelope may be directed to a patient or subject under examination.

In order to produce x-rays, the envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100–200 kV, is applied between the cathode assembly and the anode assembly. This potential causes the electrons to flow from the cathode assembly to the anode assembly through the evacuated region in the interior of the envelope. A cathode focusing cup containing the cathode filament focuses the electrons onto a small area or focal spot on a target of the anode assembly. The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays a rotating anode assembly configuration has been adopted for many applications. In this configuration, the anode assembly is rotated about an axis such that the electron beam focused on a focal spot of the target impinges on a continuously rotating circular path about a peripheral edge of the target. Each portion along the circular path becomes heated to a very high temperature during the generation of x-rays and is cooled as it is rotated before returning to be struck again by the electron beam. In many high powered x-ray tube applications such as CT, the generation of x-rays often causes the anode assembly to be heated to a temperature range of 1200–1400° C., for example.

In order to provide for rotation, the anode assembly is typically mounted to a rotor which is rotated by an induction motor. The rotor in turn is rotatably supported by a bearing assembly. The bearing assembly provides for a smooth rotation of the rotor and anode assembly about its axis. The bearing assembly typically includes at least two sets of ball bearings disposed in a bearing housing. The ball bearings often consist of a ring of metal balls which are lubricated by application of lead or silver to an outer surface of each ball thereby providing support to the rotor with minimal frictional resistance.

During operation of the x-ray tube, the anode assembly is passively cooled by use of oil or other cooling fluid flowing within the housing which serves to absorb heat radiated by the anode assembly through the envelope. However, a portion of the heat radiating from the anode assembly is also absorbed by the rotor and bearing assembly. For example, heat radiated from the anode assembly has been found to subject the bearing assembly to temperatures of approximately 400° C. in many high powered applications. Unfortunately, such heat transfer to the bearings may deleteriously effect the bearing performance. For instance, prolonged or excessive heating to the lubricant applied to each ball of a bearing can reduce the effectiveness of such lubricant. Further, prolonged and/or excessive heating may also deleteriously effect the life of the bearings and thus the life of the x-ray tube.

One known method to reduce the amount of heat passed from the anode assembly to the bearing assembly is to mechanically secure a heat shield to the rotor. The heat shield serves to protect the bearing assembly from a portion of the heat radiated from the anode assembly in the direction of the bearing assembly. Unfortunately, heat shields are not able to completely protect the bearing assembly from heat transfer from the anode assembly and a portion of the heat radiated will be absorbed by the bearing assembly. Additionally, although the heat shield is useful in preventing some heat transfer to the bearing assembly, the heat shield does not play a role in cooling the bearing assembly by removing heat already absorbed therein. Further, given that the bearing assembly is enclosed by the rotor, the bearing assembly is not able to easily radiate heat to the cooling fluid contained in the housing as done by the anode assembly. In fact, some rotor and bearing assembly configurations operate as a heat sink. For these reasons, a substantial amount of heat is typically transferred into the bearing assembly and the heat is not readily dissipated.

Another method to reduce heating of bearings is to pass cooling fluid through an internal conduit in the bearing assembly. For example, as described in U.S. Pat. No. 6,011,829, cooling fluid is supplied through two separate input tubes from a heat exchanger into the x-ray tube housing. A first supply tube provides cooling fluid through a first opening in the housing to be directed to a cooling fluid shaft along an inner surface of the bearing housing. A separate second supply tube provides cooling fluid through a second opening in the housing directly into the chamber surrounding the x-ray tube. A fluid flow regulator consisting of conventional valve controls is located outside the tube housing in the heat exchanger. The regulator valves control the flow rate of cooling fluid through each of the respective inlet tubes and openings in the housing wall. A third cooling fluid return port circulates the cooling fluid back to the heat exchanger. However, it is desirable to reduce the number of supply tubes, openings and fluid connections in the housing. In addition it is desirable to simplify the fluid flow regulator.

Therefore, what is needed is an apparatus for effectively and simply directing the appropriate volume of cooling fluid into each of (i) the chamber within the housing that surrounds the x-ray tube and (ii) the cooling fluid shaft along the inner surface of the bearing housing for the x-ray tube located within the housing.

SUMMARY OF THE INVENTION

In accordance with the present invention, an x-ray apparatus is provided. The x-ray apparatus includes a housing defining a chamber. The x-ray tube housing has a fluid input port. The x-ray tube includes a cathode assembly having a filament which emits electrons when heated, an anode assembly defining a target for intercepting the electrons such that collision between the electrons and the anode assembly generate x-rays from an anode focal spot and a bearing assembly rotatably supporting the anode assembly. The bearing assembly includes a fluid channel for providing a flow of fluid across a surface of the bearing assembly. An envelope encloses the anode assembly, the cathode assembly and bearing assembly in a vacuum. The invention includes a fluid director received in the fluid input port, the fluid director has a fluid input aperture, a first fluid output aperture operatively connected to provide fluid into a first fluid path and a second fluid output aperture to provide fluid into a second fluid path. The fluid input aperture is in fluid communication with both of the first and second fluid output apertures.

In a more limited aspect of the invention, the first fluid path includes the fluid channel.

In a further limited aspect of the invention, the fluid channel is internal to the bearing assembly.

In another limited aspect of the invention, a portion of each of the first and second fluid paths is common to both fluid paths.

Yet another limited aspect of the invention includes establishing the size of the first fluid output aperture and second fluid output aperture in a predetermined ratio to provide a desired portion of the supplied flow of fluid through at least one of the first and second fluid output aperture.

In a more limited aspect of this invention, the fluid flow from the first and second fluid output apertures is equal.

In another limited aspect of the invention, the fluid director includes a wall portion that defines a cavity in fluid communication with the input aperture. The wall portion includes a side wall portion and an end wall.

In a more limited aspect of the invention, the first fluid output aperture is in the end wall and the second fluid output aperture is in the side wall.

In another more limited aspect of the invention, the area of the second fluid output aperture is divided into a plurality of apertures that provide fluid flow into the second fluid path.

In yet another more limited aspect of the invention, the fluid director includes a tubular member connecting the first fluid path with the first fluid output aperture.

In accordance with the present invention, a method for cooling a bearing assembly in an x-ray tube includes the step of supplying fluid flow through a fluid input aperture into a cavity of a fluid director. The fluid director is located in a housing of an x-ray tube assembly and the housing of the x-ray tube assembly defines a chamber. The method further includes the step of directing a predetermined portion of the fluid flow supplied into the cavity out a first output aperture into a first fluid path. The first fluid path includes a cooling channel along a surface of the bearing assembly. Another step in the method of the present invention is directing the remaining fluid flow into the chamber through a second fluid path that does not include the cooling channel in the bearing assembly of the x-ray tube.

One advantage of the present invention is that cooling fluid is directed into different fluid flow paths using a fluid flux director. The present invention provides fluid at the predetermined portion of supply fluid into each path.

Another advantage of the present invention is that supply of the plurality of fluid paths with their specific fluid requirements may be accomplished without additional pumps being installed in the system. This is particularly advantageous in Computed Tomography systems in which the X-Ray Tube housing assembly, including the fluid systems, is rotated around a gantry.

Yet another advantage of the present invention is that there is only a single input port for the cooling fluid through the housing. Two different fluid flow requirements are served with a single fluid input port.

Another advantage of the present invention is that it permits the retrofit installation of x-ray tube inserts having fluid cooled bearing assemblies into existing systems which are not so equipped. The installation of the fluid flux director into the presently existing input port of an existing x-ray tube housing facilitates the simultaneous retrofit installation of an x-ray tube having a fluid cooled bearing assembly.

And yet another advantage of the present invention is the structure of the fluid flux director having a predetermined size for the fluid output apertures to achieve the desired portion of fluid flow into each fluid path.

To accomplish the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENT

Figure 1:
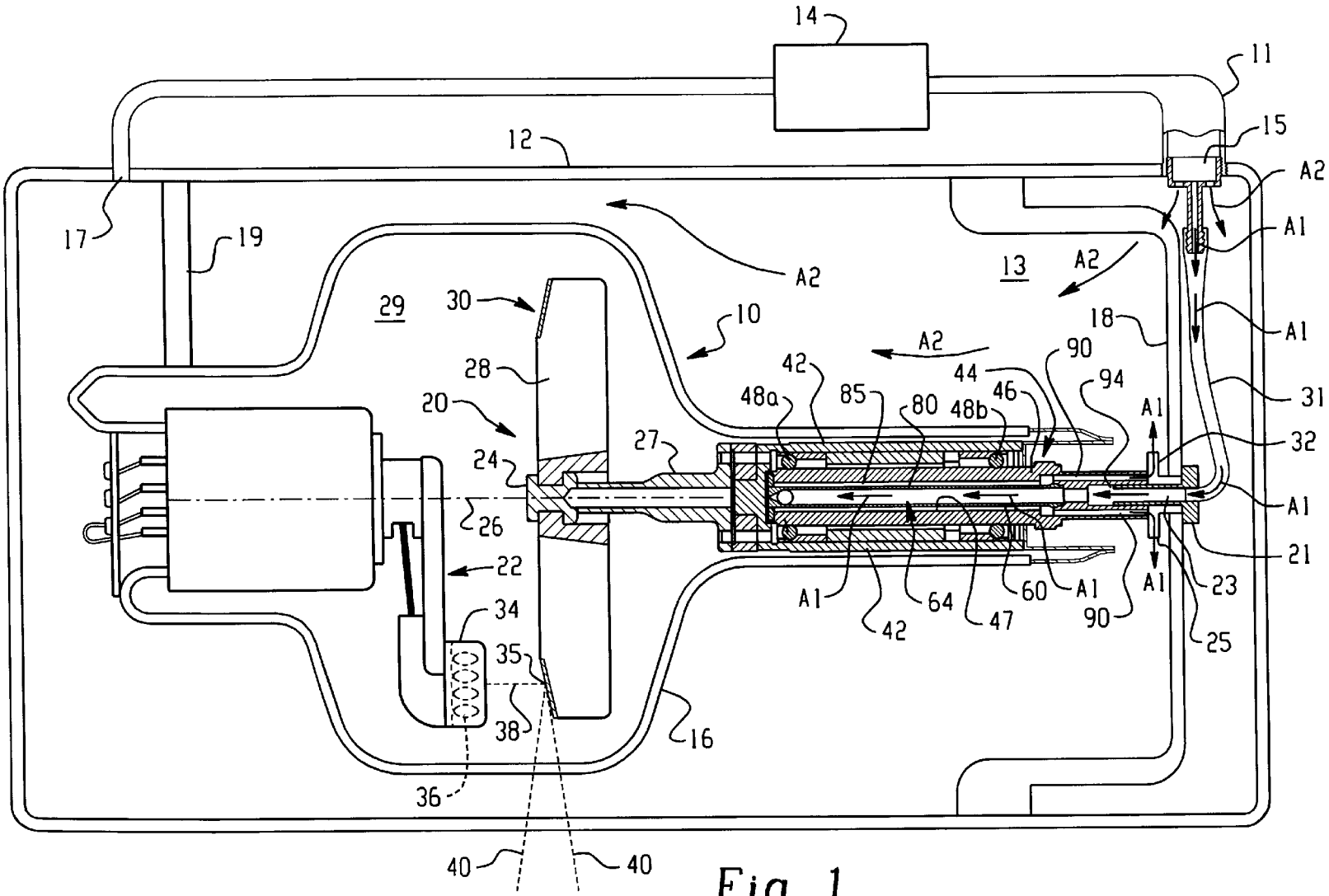
FIG. 1 is a schematic partial cross sectional view of an x-ray apparatus in accordance with features of the present invention.

Referring to FIG. 1, an x-ray tube 10 is mounted within an x-ray tube housing 12 in a predominantly conventional manner by way of an anode bracket 18 and a cathode bracket 19. One difference from the majority of conventional x-ray tubes is that in the x-ray tube described herein includes a mounting bolt 21 connecting the x-ray tube 10 to the anode bracket 18 that includes an oil inlet bore 23, as is discussed more fully below. A spacer 25 disposed between the anode bracket 18 and the x-ray tube 10 aids in reliably securing the x-ray tube 10 in place. The spacer 25 further includes four oil exit slots 32 branching off a circular oil outlet groove (not shown) to provide a path for oil to be returned to a chamber 13 defined by the housing 12 as discussed in more detail below.

In the present embodiment the oil contained in the chamber 13 is a diala oil, however it will be appreciated that other suitable cooling fluid/medium, such as air, could alternatively be used. The oil within the chamber 13 is pumped through the x-ray tube housing 12 where it flows across a stator (not shown) and an outer surface of an envelope 16 of the x-ray tube 10 so as to absorb heat generated from within the x-ray tube 10 and transfer such heat to a heat exchanger 14 disposed outside the x-ray tube housing 12. The heat exchanger 14 is coupled to provide cooling fluid to the housing 12 by way of a cooling fluid flow tube 11 and a cooling fluid flux director 15. An outlet port 17 provides return fluid flow to the heat exchanger 14.

The envelope 16 of the x-ray tube 10 defines an evacuated chamber or vacuum 29. The envelope 16 is made of glass, although other suitable material including other ceramics or metals could also be used. Disposed within the envelope 16 is an anode assembly 20 and a cathode assembly 22. The anode assembly 20 includes a circular target 28 having a focal track 30 along a peripheral edge of the target. The focal track 30 is comprised of a tungsten alloy or other suitable material capable of producing x-rays when bombarded by electrons. The cathode assembly 22 is stationary in nature and includes a cathode focusing cup 34 positioned in a spaced relationship with respect to the focal track 30 for focusing electrons to a focal spot 35 on the focal track 30. A cathode filament 36 (shown in phantom) mounted to the cathode focusing cup 34 is energized to emit electrons 38 which are accelerated to the focal spot 35 to produce x-rays 40.

The anode assembly 20 is mounted to a rotor stem 27 using securing nut 24 and is rotated about an axis of rotation 26 during operation. The rotor stem 27 is connected to a rotor body 42 which is rotated about the axis 26 by an electrical stator (not shown). The rotor body 42 houses a bearing assembly 44. The bearing assembly 44 includes a cylindrically hollow bearing housing 46. Disposed within the bearing housing 46 is an inner cooling shaft 60. The cooling shaft 60 includes a central bore 64 which generally follows the axis 26. Placement of the cooling shaft 60 within the bearing housing 46 defines an oil return path 85 between the inner surface 47 of the bearing housing 46 and the outer surface 80 of the cooling shaft 60. The central bore 64 and the oil return path 85 define a cooling channel within the bearing assembly 44 which directs oil in a desired manner through the bearing assembly 44 to obtain effective cooling thereof. More detailed description of such a cooling arrangement for an x-ray tube bearing assembly appears in U.S. Pat. No. 6,011,829 owned by the assignee of the present invention entitled "Liquid Cooled Bearing Assembly For X-Ray Tubes" issued to Panisik, the entirety of which is fully incorporated herein by reference.

Continuing to refer to FIG. 1, the mounting bolt 21 is threaded into a corresponding securing aperture defined by the bearing housing 46 for securing the x-ray tube 10 to the anode bracket 18. As mentioned above, the mounting bolt 21 of the present embodiment includes the oil inlet aperture 23. The inlet aperture 23 is also threaded to allow for an end of a bearing cooling fluid supply tube 31 to be secured to the mounting bolt 21 in a reliable manner. Preferably, the bearing cooling fluid supply tube 31 is made from a material such as a Fluoropolymer FEP tubing such as FEP3-030 produced by the Paraflex Division of the Parker Hannifin Corporation, located in Ravenna, Ohio. The tubing may be used in a wide temperature range, e.g. −110° F.(−79° C.) to 440° F.(204° C.).

The inlet aperture 23 provides an opening through which oil may flow to the bearing assembly 44 without disturbing the vacuum state of the x-ray tube 10. In this example, the inlet aperture 23 is 0.08 inches in diameter, however, the diameter may be modified to allow for varied oil flow rates depending on specific tube operating characteristics and heat removal objectives. Unlike conventional x-ray tubes in which oil or other cooling fluid may only contact a small portion of an exterior of the bearing assembly which protrudes from an x-ray tube envelope, the inlet aperture 23 allows oil or other cooling fluid to enter an interior of the bearing assembly 44 whereby such oil is better able to cool the bearings. It is necessary to pump the cooling fluid through the bearing assembly to reach the typical decrease in bearing race temperature of 100° C. using the liquid cooled bearing assembly.

As presently described, from a single fluid input, there are two cooling fluid flow paths exiting the flux director 15 in the x-ray tube housing. One path, shown by the arrows A1, is from the cooling fluid flow tube 11 into the cooling fluid flux director 15 through the tubing 31 into bearing assembly cooling shaft 60, along the inner surface of the bearing housing, into the housing chamber 13. This path, A1, provides fluid to cool an interior surface of the bearing assembly. The other path, shown by the arrows A2, is from the cooling fluid flow tube 11, into the cooling fluid flux director 15, into the housing chamber 13 and exiting through the outlet port 17. This second fluid flow path, A2, circulates cooling fluid past the evacuated envelope 16 to cool the x-ray tube in a conventional manner. After path A1 exits the bearing assembly, it merges with path A2 in the chamber 13. Both fluid paths exit the chamber 13 and the return to the heat exchanger through the outlet port 17.

It is desirable to provide each of these flow paths with the appropriate predetermined portion of fluid flow of cooling oil. However, it is not desirable to have a plurality of pumps or a plurality of fluid input ports in the housing to provide each path with its appropriate fluid flow volume, i.e. one pump and/or cooling input port for each flow path. The additional weight and space occupied by an additional pump is not desirable for cost and other reasons, particularly in rotating applications such as a Computed Tomography system. Additional fluid input ports present additional openings in the housing that must be properly sealed. It is desirable to supply the necessary cooling fluid into each fluid flow path with a single pump located in the heat exchanger assembly and through a single cooling fluid inlet port opening in the housing. In addition, it is desirable to provide an apparatus to control the distribution of liquid flow in each of the fluid flow paths that can be installed into existing systems without substantial modification of existing heat exchanger, the housing and other connected fluid system components. The cooling fluid supply into each of the flow paths is controlled with the apparatus of the present invention, the cooling fluid flux director 15, as described in greater detail below.

Figure 2D:
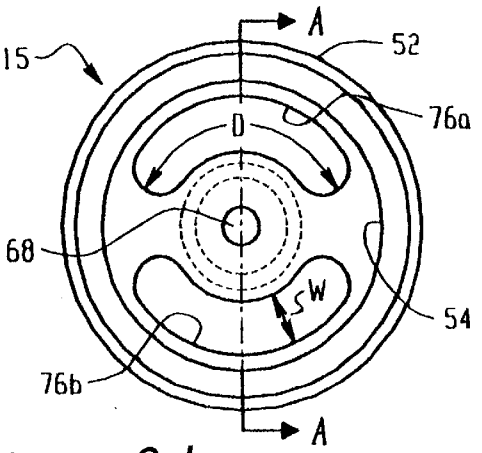
FIGS. 2*a*, 2*b*, 2*c*, 2*d* and 2*e* are cross sectional and end views of flux director apparatus in accordance with features of the present invention.
Figure 2E:
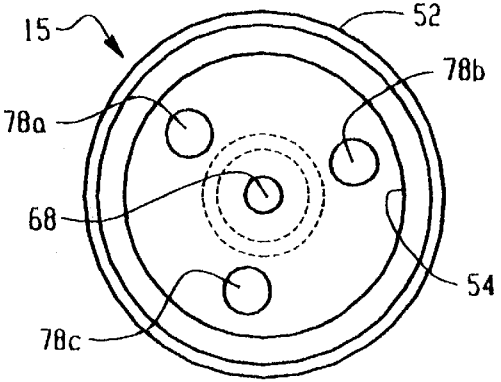
Figure 2A:
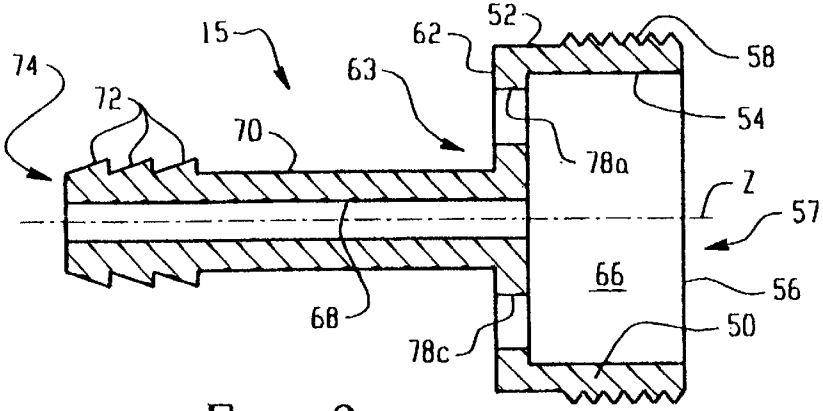

Turning now to FIG. 2*a,* the preferred embodiment of the liquid flux director 15 is shown. The cooling fluid liquid flux director 15 includes a cylindrical wall section 50 that has its generally central major axis extending generally along the axis Z. The wall section 50 has a cylindrical outer surface 52 and a cylindrical inner surface 54. An opening 56 at one end of the cylindrical wall section 50 serves as a fluid input end 57 of the flux director 15. A connecting portion 58 of the outer surface 52 is threaded.

The distal end of the cylindrical wall 50 has a circular end wall 62 at a cooling fluid output end 63. The end wall 65 includes a circular centrally located first fluid output aperture 68 generally located at its center. For example, the first fluid output aperture 68 has a diameter of 0.08 in. The diameter or size of the first fluid output aperture 68 is not limited to this specific size and is different as required for specific cooling needs of a particular associated x-ray tube. The volume within the cylindrical wall section 50 and two ends 57, 63 forms a cavity 66 that receives cooling fluid through the opening 56.

A tubular extension 70 has its major axis generally along the axis Z and extends away from the end wall 62. The inside diameter of the tubular extension 70 is the same as the diameter of the first fluid output aperture 68. The tubular extension 70 is in fluid communication with first fluid output aperture 68 in the center of the end wall 62, and thus with the cavity 66. The hollow tubular extension 70 provides a conduit for cooling fluid to exit the cavity 66 through the first fluid output aperture 68 into the first fluid path A1. This is the fluid path that provides cooling fluid into bearing assembly 44. The distal end of the tubular extension 70 includes a plurality of raised truncated conical sections or ridges 72 on the outer surface of an output end 74 of the tube 70. The ridges 72 grip the inside diameter of the cooling fluid tube 31 (FIG. 3) connected to the oil inlet bore 23 in the mounting bolt 21 (FIG. 1).

The circular end wall 62 includes partial circumferentially spaced second and third fluid output apertures 76*a*, 76*b* that extend a desired arcuate distance D around the circular end wall 62. The second 76*a* and third 76*b* fluid output apertures are radially located from the first aperture and have a width W. These apertures 76*a*, 76*b* channel fluid into the second fluid path A2 into the x-ray tube housing chamber 13.

The fluid output apertures 68, 76*a*, 76*b*, are a specific size/area and number to direct a desired volume of cooling fluid flow from the heat exchanger pump (not shown). The pump circulates cooling fluid under pressure into the flux director 15 which directs fluid through apertures 76*a*, 76*b* into the housing chamber 13 along fluid path A2. In addition, the flux director 15 also branches cooling fluid through the first fluid output aperture 68 into the liquid cooled bearing assembly along fluid path A1. The size/area of the flux apertures, and their relative ratios, are determined by the pressure required to pump cooling fluid through the main housing 12 and heat exchanger 14 and the desired volume of fluid flow through the cooling channel. In this embodiment, the total cooling fluid flow rate is 7 gallons per minuet (GPM). From modeling, the pressure drop through the liquid cooled bearing assembly along the flow path A1 is 6 psid and the oil flow rate therethrough is 0.26 GPM. Thus, the cooling fluid flow rate to fluid path A2, by-passing the flow path A1, is 7−0.25=6.75 GPM. As described above, the diameter of the first fluid output aperture 68 is 0.08 in. The combined area of the second and third fluid output apertures 76*a*, 76*b* is determined to maintain the necessary flow rate through the first fluid output aperture 68 into the flow path A1.

Determining the total area to be divided between the second and third fluid output apertures 76*a*, 76*b* which provide the desired fluid to the fluid path A2, begins with the equation:

$$\Delta P = k \cdot \rho \frac{Vel^2}{2} \tag{1}$$

Where:

ΔP=pressure across the flux apertures to fluid path A2 k=the loss coefficient

ρ=oil density

Vel=oil velocity

Equation (1) can be rearranged to yield:

$$d = \left(8 \cdot k \cdot \rho \cdot \frac{vol^2}{\pi^2 \cdot \Delta P}\right)^{1/4} \tag{2}$$

Where:

d=the hydraulic diameter of total flux aperture area to fluid path A2 vol=the volumetric flow rate of the oil into fluid path A2

The loss coefficient k is estimated as 0.97. Frank M. White, *Fluid Mechanics,* published by McGraw-Hill (1979). In addition, the following values are converted into metric units, if in English units, and inserted into equation (2):

ρ=870

AP=(6 psid)(6894.76) and vol=(7−0.25 GPM)($6.30903 \cdot 10^{-5}$)

Solving for d, the hydraulic diameter of the total flux aperture area providing fluid to the flow path A2:

d=$7.4 \times 10^{-3}$ mm

Determining the total required Area, $A_o$ representing the total area of the second and third fluid output apertures 76*a*, 76*b* utilizes the following equation:

$$A_O = \frac{\pi d^2}{4}$$

Solving for $A_o$: $A_o = 4.301 \times 10^{-5}$ $m^2$

Referring to FIG. 2*a*, the total area $A_o$ is allocated between the second and third fluid output apertures 76*a*, 76*b*. It is to be appreciated that the area for all of the fluid output apertures 68, 76*a* and 76*b* are selected for a given desired cooling rate and fluid pumping rate dependent on the requirements of a specific tube design. The desired cooling fluid flow for the first fluid path A1 and- or second fluid path A2 may vary from that described herein, depending on desired cooling for specific tube requirements.

Figure 2B:
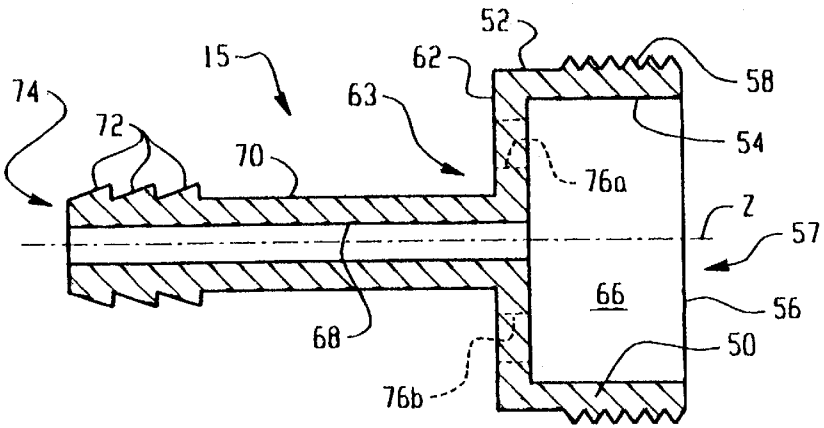

Another embodiment of a liquid flux director having a different arrangement of the fluid output apertures for the fluid path A2 into the housing 12 is shown in FIG. 2*b*. A plurality of circular apertures 78*a*, 78*b* and 78*c* are located in the end wall 62. The fluid output apertures 78*a*, 78*b* and 78*c* are radially located from first fluid output aperture 68. The total area of each aperture 78*a*, 78*b*, and 78*c* is summed with the other output apertures to fluid path A2 to equal the area $A_o$.

Figure 2C:
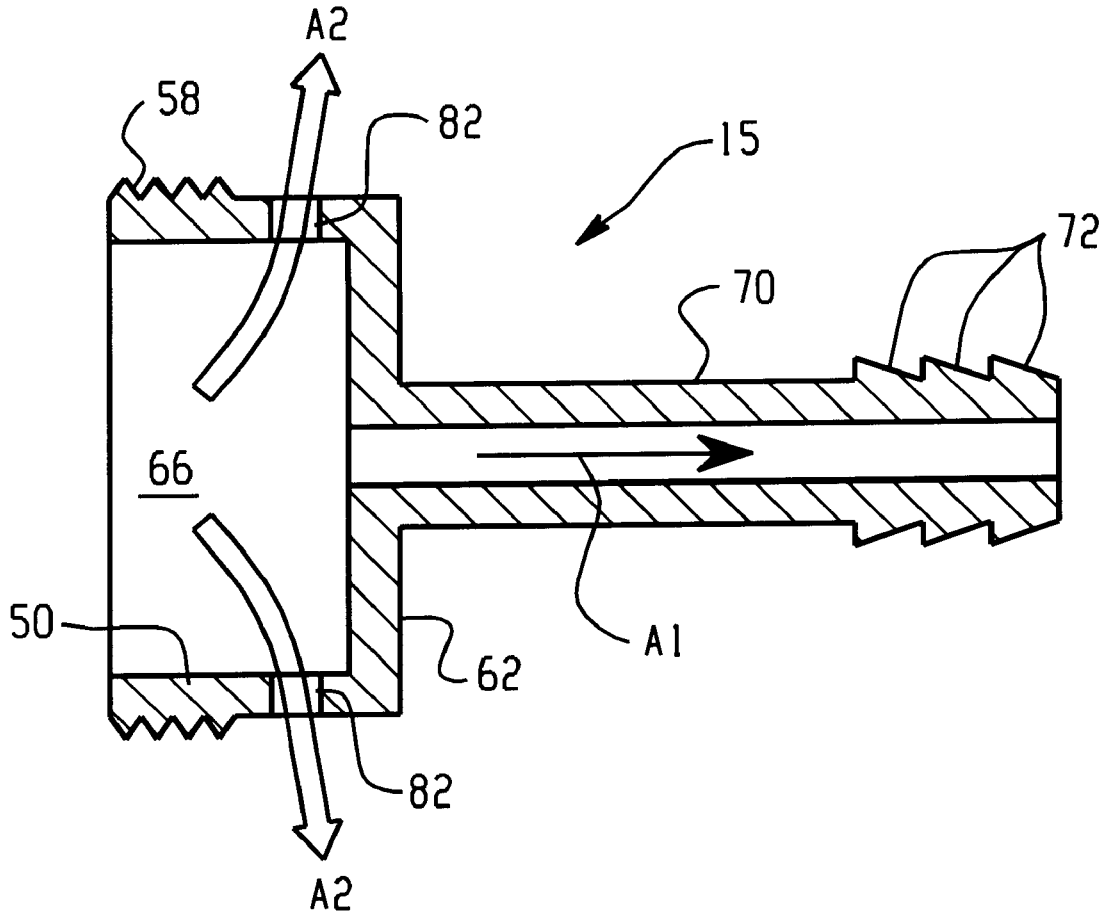

Referring to FIG. 2*c*, yet another embodiment of a liquid flux director 15 has a plurality of apertures 82 located circumferentially around the cylindrical wall section 50 for the fluid path A2 into the housing includes It is to be appreciated that any combination of locations or shapes of fluid apertures can be used for the fluid path A2 on any of the wall sections or elements of the flux director that provides for a contribution to the determined area AO such that cooling fluid is provided to the housing chamber 13 while maintaining the desired portion of cooling fluid flow in fluid path A1.

Figure 3:
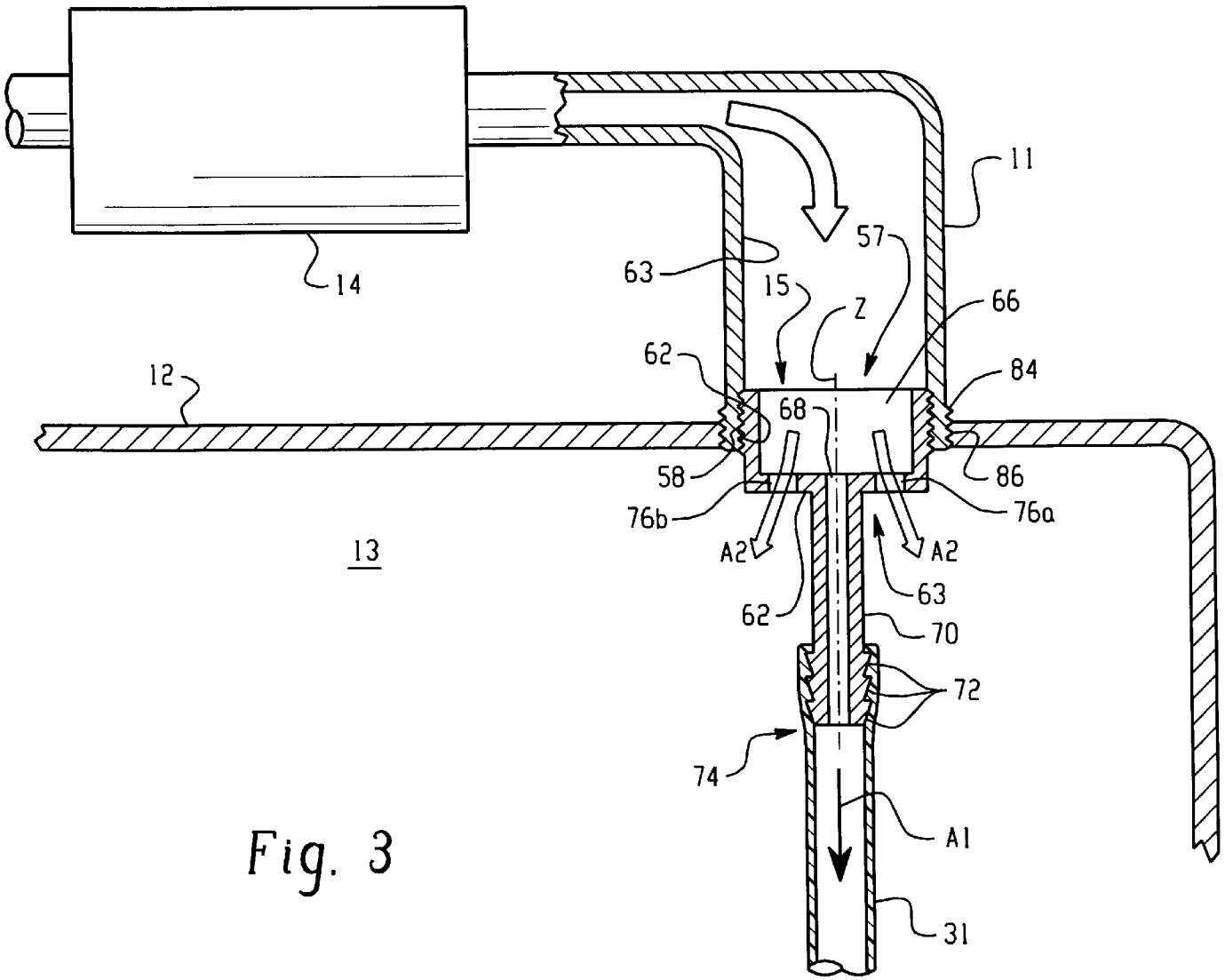
FIG. 3 is an enlarged partial schematic cross sectional representation of a flux director installed in the x-ray apparatus of FIG. 1 showing features of the present invention.

Referring now to FIG. 3, the cooling liquid flux director 14 is schematically shown connected to the cooling fluid flow tube 11 and assembled in the housing 12. The connecting portion 58 of the cooling fluid flux director is threaded to engage a matching threaded section 62 on an inner surface 63 of the cooling fluid supply tube 11. The cooling fluid supply tube 11 also has a threaded portion 84 that engages a matching threaded opening 86 of the housing 12. Once the cooling fluid supply tube 11 is threaded into the housing 12, the supply tube 11 provides a conduit for cooling fluid that is pumped under pressure from the heat exchanger 14 into the input end 57 of the cooling fluid flux director 15.

In operation, oil from the heat exchanger 14, FIGS. 1&3, is pumped into the cooling fluid supply tube 11. The cooling fluid then enters the cavity 66 of the flux director 15 via the open end 56. The desired portion of cooling fluid is directed into the first fluid output aperture 68 in fluid communication with the tubular extension 70. The fluid in this path is circulated in fluid path A1 and enters the cooling fluid supply tube 31. Referring now to FIG. 1, the cooling fluid now passes through the mounting bolt 21 through the oil inlet bore 23. Once through the bore 23, the cooling fluid is circulated through the bearing assembly 44 so as to allow for direct cooling of the interior of the bearing assembly 44 via thermal conduction. Specifically, the oil flows out the distal end of the oil cooling shaft, nearest the anode assembly 20, to the outer surface 80 of the cooling shaft 60, and is directed through oil return path back towards the mounting bolt 21 and exits at the oil exit slots 32 into the housing chamber 13.

During passage of the oil through oil return path, heat from the bearing housing 46 is absorbed by the oil which in turn reduces the amount of heat transferred by the bearing housing 46 to the bearings 48*a,* 48*b*. By virtue of passing the oil through oil return path along the inner surface of the bearing housing, the oil is able to effectively reduce the temperature of the bearings 48*a,* 48*b* during operation of the x-ray tube 10. Further, by virtue of directly exposing a large surface area of the bearing housing 46 to the oil, heat may be dissipated anywhere along the surfaces of the bearing assembly 44 exposed to the oil and thus heat is able to readily pass to the oil and be removed from the bearing assembly 44.

As briefly discussed above, the number and size of the oil return path is configured and selected such that it is able to return the oil to the chamber 13 at the desired flow rate. Once in the oil filled chamber 13, the oil is circulated with the oil form the path A2 and is pumped back to the heat exchanger 14 via outlet port 17 using conventional techniques know in the art. In order to obtain the desired cooling effects in the present embodiment, the oil passing to the bearing assembly 44 through the fluid path A1 and the first cooling fluid output aperture 68 is pumped such that the oil has a flow rate of 0.25 gallons per minute (GPM) with a 6 pounds per square inch differential pressure drop (psid). At this oil flow rate and pressure drop, the oil passing through the bearing assembly 44 has the effect of cooling the bearings 48*a,* 48*b* by approximately 100° C. If the oil flow rate were increased in the present embodiment, this would have the effect of further cooling the bearings 48*a,* 48*b*. Similarly, if the clearance between the cooling shaft 60 and the bearing housing 46 in the oil return path were increased, this would also have the affect of further reducing bearing temperature. For most typical x-ray tube applications, it is expected that an oil flow rate of between 0.1 and 0.4 GPM would be desirous to obtain optimal cooling effects. Thus, it will be appreciated that although the preferred embodiment describes certain dimensions for the fluid path through which the oil flows within the bearing assembly 44 and flow rates for the oil, such specifications may be varied to accommodate the needs of a given x-ray tube operation and configuration.

As described above, the combined area of the second fluid output apertures which supply the desired portion of cooling fluid to path A2 is selected such that the fluid requirements for path A1 are generally satisfied. The cooling fluid leaves the cavity 66 through the apertures 76*a,b* or 78*a,b,c* or 82, (depending on the embodiment) into the housing chamber 13. The cooling fluid passes along the evacuated envelope 16 near the bearing assembly 44, toward the anode assembly 20 and cathode assembly 22. As the oil in path A2 passes the envelope, heat that has been radiated from the internal components of the x-ray tube is absorbed. The location of the outlet port 17 assists in directing the path A2 along the desired surfaces of the envelope. In addition, the fluid from path A1 exits into the chamber 13 and mixes with the fluid in path A2. The oil from both paths A1 and A2 in the oil filled chamber 13 is pumped back to the heat exchanger 14 via outlet port 17 using conventional techniques know in the art.

The invention has been described with reference to the preferred embodiments. Obviously, modifications and alterations will occur to others upon reading and understanding the preceding detailed description. It is intended that the invention be construed as including all such modifications, alterations and others insofar as they come within the scope of the appended claims or their equivalence thereof.

What is claimed is:

1. An x-ray apparatus comprising:

an x-ray tube housing defining a chamber, the tube housing having a fluid input port;

an x-ray tube disposed within the chamber, the x-ray tube including:

a cathode assembly;

an anode assembly;

a bearing assembly rotatably supporting the anode assembly;

a fluid channel for providing a flow of fluid across a surface of the bearing assembly; and an envelope enclosing the anode assembly, bearing assembly and the cathode assembly in a vacuum; and a fluid director received in the fluid input port, the fluid director having a fluid input aperture, a first fluid output aperture operatively connected to provide fluid into a first fluid path and a second fluid output aperture to provide fluid into a second fluid path, the fluid input aperture in fluid communication with both of the first and second fluid output apertures.

2. The x-ray apparatus of claim 1 wherein the first fluid path includes the fluid channel.

3. The x-ray apparatus of claim 2 wherein the fluid channel is internal to the bearing assembly.

4. The x-ray apparatus of claim 1 wherein a portion of each of the first and second fluid paths is common to both fluid paths.

5. The x-ray apparatus of claim 1 wherein the size of the first fluid output aperture and second fluid output aperture are predetermined to provide a predetermined portion of the supplied flow of fluid through at least one of the first and second fluid output aperture.

6. The x-ray apparatus of claim 5 wherein the fluid flow from the first and second fluid output apertures is equal.

7. The x-ray apparatus of claim 1 wherein the fluid director includes a wall portion that defines a cavity in fluid communication with the input aperture, the wall portion including a side wall portion and an end wall.

8. The x-ray apparatus of claim 7 wherein the first fluid output aperture is in the end wall and the second fluid output aperture is in the side wall.

9. The x-ray apparatus of claim 5 wherein the area of the second fluid output aperture comprises a plurality of apertures that provide fluid flow into the second fluid path.

10. The x-ray apparatus of claim 9 wherein the fluid flow from the first and second fluid output apertures is equal.

11. The x-ray apparatus of claim 8 including a tubular member defining the first fluid path in fluid communication with the first fluid output aperture.

12. The x-ray apparatus of claim 7 wherein the cavity is in direct fluid communication with the fluid input aperture and both of the first fluid output aperture and the second fluid output aperture.

13. A method for cooling a bearing assembly in an x-ray tube, the method including the steps of:

supplying fluid flow through an aperture into a cavity of a fluid director located in a housing of an x-ray tube assembly, the housing of the x-ray tube assembly defining a chamber;

directing a predetermined portion of the fluid flow supplied into the cavity out a first output aperture of the fluid director into a first fluid path, the first fluid path including a cooling channel along a surface of the bearing assembly; and directing the remaining fluid flow into the chamber through a second output aperture of the fluid director to a second fluid path external to the bearing assembly of the x-ray tube, the fluid input aperture in fluid communication with both of the first and second fluid output apertures.

14. The method for cooling a bearing assembly in an x-ray tube of claim 13 including the step of circulating the combined fluid flow from the first fluid path and the second fluid path into a fluid reservoir.

15. The method for cooling a bearing assembly in an x-ray tube of claim 14 including the step of removing heat from the fluid in the reservoir.

16. An apparatus for directing fluid flow to a plurality of fluid flow paths, the apparatus comprising:

a wall section defining a cavity;

a fluid input aperture in the wall section, the fluid input aperture at a first end of the wall section;

a first fluid output aperture at a second end of the wall section, the first fluid output aperture for fluid communication with a first fluid path;

a second fluid output aperture at the second end of the wall section, the second fluid output aperture for fluid communication with a second fluid path, the fluid input aperture in fluid communication with both of the first and second fluid output apertures.

17. The apparatus for directing fluid flow of claim 16 including a tubular member in fluid communication with one of the first and second fluid output aperture.

18. The apparatus for directing fluid flow of claim 16 wherein the cavity is in direct fluid communication with the fluid input aperture and both of the first fluid output aperture and the second fluid output aperture.

19. The apparatus for directing fluid flow of claim 16 wherein the size of the first fluid output aperture has a ratio with the second fluid output aperture that results in providing a predetermined portion of the supplied flow of fluid to at least one of the first and second fluid output aperture.

20. The apparatus for directing fluid flow of claim 19 wherein the area of the second fluid output aperture is divided into a plurality of apertures that provide fluid flow into the second fluid path.

21. The apparatus for directing fluid flow of claim 19 wherein the fluid flow from the first and second fluid output apertures is equal.

22. A method for directing fluid flow from a supply to a plurality of output fluid flow paths, the method including the steps of:

supplying fluid flow through an aperture into a fluid director;

directing a predetermined portion of the fluid flow supplied into the fluid director out a first output aperture in the fluid director through a first fluid path; and directing the remaining fluid flow into the chamber through a second fluid output aperture in the fluid director into a second fluid path, the fluid input aperture in fluid communication with both of the first and second fluid output apertures.

23. The method for directing fluid flow from a supply to a plurality of output fluid flow paths of claim 22 including the step of circulating the combined fluid flow from the output of the first fluid path and the output of the second fluid path into a fluid reservoir.

* * * * *